US008497456B2

(12) United States Patent
Eisentraut

(10) Patent No.: US 8,497,456 B2
(45) Date of Patent: Jul. 30, 2013

(54) GUIDED MUNITIONS INCLUDING INTERLOCKING DOME COVERS AND METHODS FOR EQUIPPING GUIDED MUNITIONS WITH THE SAME

(75) Inventor: Rudy A. Eisentraut, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 239 days.

(21) Appl. No.: 13/075,725

(22) Filed: Mar. 30, 2011

(65) Prior Publication Data

US 2012/0248236 A1 Oct. 4, 2012

(51) Int. Cl.

| | |
|---|---|
| ***H01Q 1/42*** | (2006.01) |
| ***F42B 15/01*** | (2006.01) |
| *H01Q 1/00* | (2006.01) |
| *F42B 15/00* | (2006.01) |

(52) U.S. Cl.

USPC ..... 244/3.1; 244/3.15; 343/872; 342/61; 342/62

(58) Field of Classification Search

USPC ..... 244/3.1–3.19, 1 R, 117 R, 119, 121, 244/158.1, 158.9, 159.1, 173.1, 173.2; 343/872, 343/873; 102/374, 377, 378, 399, 501, 293; 89/1.11; 342/61, 62

See application file for complete search history.

(56) References Cited

U.S. PATENT DOCUMENTS

| | | | | | |
|---|---|---|---|---|---|
| 2,782,716 | A | * | 2/1957 | Johnston | 102/378 |
| 2,987,999 | A | * | 6/1961 | Robinson, Jr. et al. | 102/501 |
| 3,080,817 | A | * | 3/1963 | Robinson, Jr. et al. | 102/501 |
| 3,135,204 | A | * | 6/1964 | Menichelli et al. | 102/399 |
| 3,351,947 | A | * | 11/1967 | Hart | 343/872 |
| 3,555,550 | A | * | 1/1971 | Walters | 343/872 |
| 3,601,055 | A | * | 8/1971 | Crockett | 102/377 |
| 3,674,227 | A | * | 7/1972 | Jacobson et al. | 244/121 |
| 3,745,928 | A | * | 7/1973 | Kinnaird et al. | 244/159.1 |
| 3,913,108 | A | * | 10/1975 | Branen | 343/872 |
| 3,960,626 | A | * | 6/1976 | Casadevall | 244/1 R |
| 3,970,006 | A | * | 7/1976 | Copeland et al. | 244/159.1 |
| 4,275,859 | A | * | 6/1981 | Bleday | 244/121 |
| 4,753,169 | A | * | 6/1988 | Shores | 102/378 |
| 4,867,357 | A | * | 9/1989 | Inglis et al. | 244/121 |
| 4,916,461 | A | * | 4/1990 | Brazel | 343/872 |
| 5,125,600 | A | * | 6/1992 | Brumbaugh | 244/121 |
| 5,159,151 | A | * | 10/1992 | Dransfield et al. | 102/293 |
| 5,167,386 | A | * | 12/1992 | Laquer et al. | 244/121 |
| 5,187,321 | A | * | 2/1993 | Tusch | 102/293 |

(Continued)

OTHER PUBLICATIONS

Armtec Defense Products Co., combustible Cartridge Product Description Web Page, 2 pages, undated; retrieved no Nov. 2, 2010 from the Internet at www.armtecdefense.com.

Merems, Paul A. "Missile with Shroud that Separates in Flight," U.S. Appl. No. 12/696,123, filed Jan. 29, 2010.

(Continued)

*Primary Examiner* — Bernarr Gregory

(74) *Attorney, Agent, or Firm* — Renner, Otto, Boisselle & Sklar, LLP

(57) ABSTRACT

Embodiments of a guided munition are provided, as are embodiments of a method for equipping a guided munition with an interlocking dome cover. In one embodiment, the guided munition includes a munition body, a seeker dome coupled to the munition body, and an interlocking dome cover. The interlocking dome cover includes a plurality of detachable dome cover sections collectively enclosing the seeker dome and a dome cover deployment device coupled to the plurality of detachable dome cover sections. When actuated, the dome cover deployment device initiates separation of the plurality of detachable dome cover sections to expose the seeker dome.

19 Claims, 4 Drawing Sheets

U.S. PATENT DOCUMENTS

| | | | | | |
|---|---|---|---|---|---|
| 5,457,471 | A | * | 10/1995 | Epperson, Jr. | 343/872 |
| 5,693,907 | A | * | 12/1997 | Rudnik | 102/293 |
| 5,743,492 | A | * | 4/1998 | Chan et al. | 102/378 |
| 5,814,754 | A | * | 9/1998 | Mangolds | 89/1.11 |
| 5,961,078 | A | * | 10/1999 | Edberg et al. | 244/173.2 |
| 6,679,453 | B2 | * | 1/2004 | Steiner | 244/121 |
| 6,854,393 | B2 | * | 2/2005 | Hazan | 102/501 |
| 7,093,799 | B1 | * | 8/2006 | Dulat et al. | 244/3.1 |
| 7,661,625 | B2 | * | 2/2010 | Rieger et al. | 244/121 |
| 8,058,595 | B2 | * | 11/2011 | Koehler et al. | 244/3.1 |

OTHER PUBLICATIONS

Williams, Darin S. et al. "Guided Munition Systems Including Combustive Dome Covers and Methods for Equipping Guided Munitions With the Same," U.S. Appl. No. 12/917,705, filed Nov. 2, 2010.

Williams, Darin S. et al. "Guided Munitions Including Self-Deploying Dome Covers and Methods for Equipping Guided Munitions with the Same," U.S. Appl. No. 12/1917,699, filed Nov. 2, 2010.

* cited by examiner

GUIDED MUNITIONS INCLUDING INTERLOCKING DOME COVERS AND METHODS FOR EQUIPPING GUIDED MUNITIONS WITH THE SAME

TECHNICAL FIELD

The following disclosure relates generally to guided munitions and, more particularly, to embodiments of guided munitions including interlocking, multi-dome cover section dome covers.

BACKGROUND

Demands for increased munition portability, versatility, and ruggedness have lead to the recent development and implementation of containerized guided missiles, which are stowed within specialized launch containers prior to launch. As do non-containerized guided missiles, containerized guided missiles typically include a homing guidance system or "seeker" containing one or more electromagnetic ("EM") radiation sensors, which detect electromagnetic radiation emitted by or reflected from a designated target. A containerized guided missile also typically includes a nose-mounted seeker dome, which protects the seeker's components while enabling transmission of electromagnetic waves within the sensor bandwidth(s) through the dome and to the seeker's EM radiation sensors.

In contrast to many conventional guided missiles, containerized guided missiles are prone to dome contamination during missile launch. Guided by the walls of the surrounding launch container, exhaust from the missile's rocket motor flows over and around the missile body in an aft-fore direction during missile launch to blow-off the container cover and thereby facilitate passage of the missile through the container's open end. Direct exposure between the motor exhaust and seeker dome can thus occur during missile launch, which may result in the deposition of harsh chemicals, soot, and other exhaust materials over the dome's outer surface. Dome contamination can block, attenuate, or otherwise interfere with the transmission of electromagnetic signals through the dome and thereby negatively impact the missile's guidance capabilities.

It is known that a dome cover can be positioned over a missile dome to minimize or prevent dome contamination during missile launch. However, inflight removal of the dome cover is required to enable subsequent operation of the seeker's EM radiation sensors. Various types of deployment systems (e.g., actuators and timing electronics) have been developed that can effectively remove a dome cover by either ejecting the cover (if fabricated from a non-frangible material) or by initiating fracture of the cover (if fabricated from a frangible material) during or immediately after missile launch. While able to effectively remove a dome cover at a desired time of deployment, such deployment systems add undesirable complexity, cost, bulk, and weight to the guided missile. Tether-pull dome cover systems have been suggested that do not require an actuator or timing electronics; however, a relatively lengthy tether is typically required to ensure that the dome cover is not removed until the missile has cleared any forward-expanding exhaust plume created during missile launch. Consequently, tether-pull dome cover systems also tend to be undesirably heavy and bulky. In addition, tether-pull dome cover systems and certain non-frangible, actuator-deployed dome covers can produce undesirably large, high-energy debris upon dome deployment.

There thus exists an ongoing need to provide embodiments of a guided munition including a dome cover that mitigates most, if not all, of the above-described limitations. In particular, it would be desirable to provide embodiments of a guided munition, such as a containerized guided munition, including a dome cover that reliably self-deploys at a desired time without the aid of an actuator, timing electronics, or similar devices. Ideally, such an interlocking dome cover would also be relatively compact, inexpensive to implement, and would produce little to no high-energy debris upon deployment. Other desirable features and characteristics of the present invention will become apparent from the subsequent Detailed Description and the appended Claims, taken in conjunction with the accompanying Drawings and this Background.

BRIEF SUMMARY

Embodiments of a guided munition are provided. In one embodiment, the guided munition includes a munition body, a seeker dome coupled to the munition body, and an interlocking dome cover. The interlocking dome cover includes a plurality of detachable dome cover sections collectively enclosing the seeker dome and a dome cover deployment device coupled to the plurality of detachable dome cover sections. When actuated, the dome cover deployment device initiates separation of the plurality of detachable dome cover sections to expose the seeker dome.

Embodiments of a method are also provided for equipping a guided munition with an interlocking dome cover. In one embodiment, the method includes the step of assembling a plurality of detachable dome cover sections over a seeker dome to form a dome-shaped structure enclosing the seeker dome, and the step of coupling a dome cover deployment device to the plurality of detachable dome cover sections to maintain the plurality of detachable dome cover sections in the assembled state over the seeker dome. The dome cover deployment device is configured to release the plurality of detachable dome cover sections from the assembled state upon actuation to enable separation of the plurality of detachable dome cover sections and exposure of the seeker dome.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
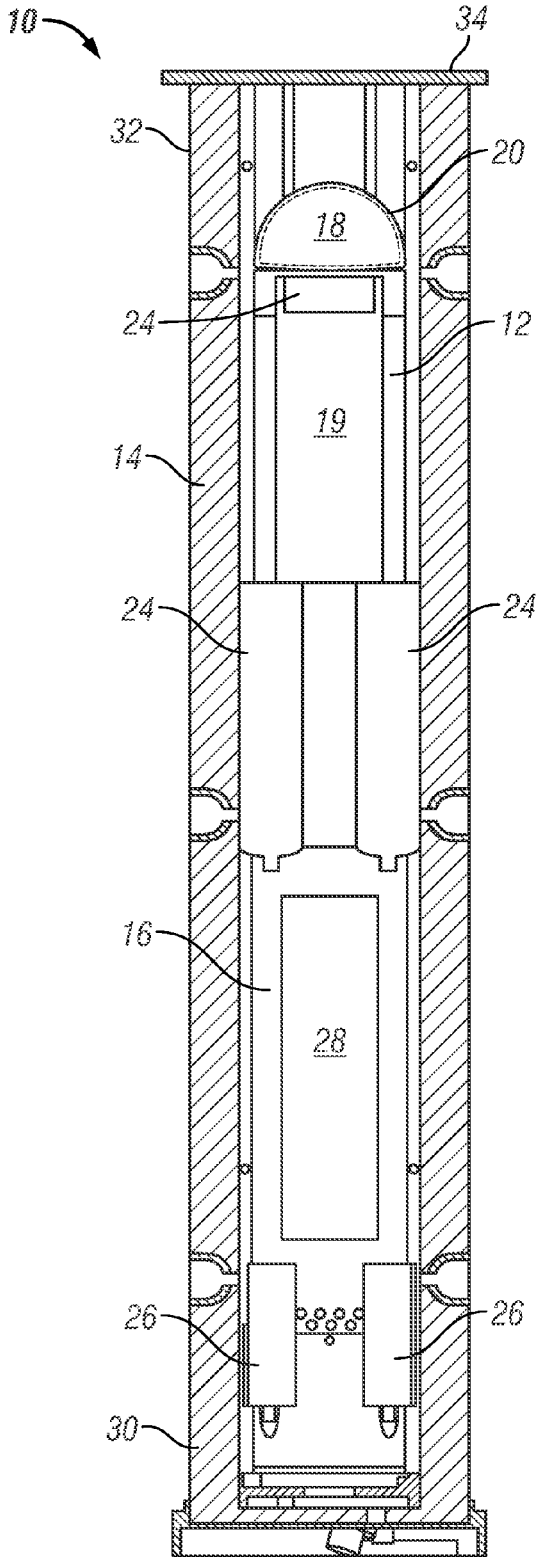
FIG. 1 is a cutaway view of an exemplary All-Up-Round including a launch container and a guided munition having an interlocking dome cover in accordance with a first exemplary embodiment.

FIG. 1 is a cutaway view of an All-Up-Round ("AUR") 10 including a guided munition 12 stowed within a launch container 14 and illustrated in accordance with an exemplary embodiment. In this particular example, guided munition 12 assumes the form of a missile, such as a precision or loitering attack missile. AUR 10 can be implemented as a standalone launch unit or may instead be packaged with other All-Up-Rounds in, for example, a palletized launch system. As a specific example, AUR 10 may be one of several All-Up-Rounds packaged within a Container Launch Unit (commonly referred to by the acronym "CLU") included within a Non-Line of Sight Launch System (commonly referred to by the acronym "NLOS-LS"). The foregoing examples notwithstanding, embodiments of the interlocking dome cover described herein are by no means limited to usage in conjunction within a particular type of launch system or in conjunction with a particular type of guided munition. Instead, embodiments of the interlocking dome cover can be utilized in conjunction with any type of guided munition that includes a seeker dome transmissive to EM radiation or EM signals of the type described herein, whether or not the guided munition is containerized. Embodiments of the interlocking dome cover are, however, particularly well-suited for utilization in conjunction with guided munitions that are containerized (i.e., initially stowed within a launch tube or other container) or otherwise shielded from significant fore-aft airflow prior to munition launch.

Guided munition 12 includes a munition body 16 and a seeker dome 18 coupled or mounted to the forward end of munition body 16. For example, seeker dome 18 may be adhesively attached to a mounting ring, which is threadably attached to the forward end of the munition fuselage, as described more fully below in conjunction with FIG. 4. A homing guidance system or seeker 19 is housed within a forward section of munition body 16 and includes one or more electromagnetic ("EM") radiation sensors 22. EM radiation sensors 22 are positioned within or adjacent to seeker dome 18; e.g., in one common implementation, sensors 22 are carried by a gimbal assembly (not shown) partially disposed within dome 18. During seeker operation or imaging, EM radiation sensors 22 detect electromagnetic radiation emitted by or reflected from a designated target or targets and transmitted through dome 18. Although not shown in FIG. 1 for clarity, seeker 19 will include a number of other conventionally-known components suitable for providing the desired homing functionalities. Such components may include, but are not limited to, guidance control electronics (e.g., a control card stack), antennae, internal navigational systems (e.g., global positioning systems and/or inertial navigational systems), power supplies (e.g., battery packs), and the like. Seeker 19 may also include a data link (e.g., a networked radio antenna) to enable the transmission of in-flight targeting updates and imaging data. More generally, guided munition 12 will likewise include various components that are conventionally-known in the aerospace or munition industry and not described in detail herein. Such components may include, but are not limited to, a plurality of manipulable flight control surfaces (e.g., wings 24 and thrust vector control vanes 26, as described more fully below), one or more warheads (not shown), and one or more propulsion devices, such as a solid propellant rocket motor (generically represented in FIG. 1 by box 28).

As previously indicated, seeker dome 18 is transmissive to one or more bandwidths of electromagnetic radiation emitted by or reflected from a designated target and detectable by EM radiation sensors 22. Seeker dome 18 will typically be transmissive to one or more of the visible, near infrared, midwave infrared, long wave infrared, and/or millimeter-wave radio frequency bandwidths. Seeker dome 18 can be formed from any material, currently known or later developed, that allows the transmission of EM radiation or signals through dome 18 within the desired sensor bandwidth(s) and that possesses sufficient structural strength to remain intact during munition handling, launch, and flight. By way of non-limiting example, seeker dome 18 may be formed from diamond, sapphire, zinc sulfide (ZnS), yttrium oxide ($Y_2O_3$) aluminum oxynitride (AlON), Spinel ($MgAl_2O_4$), magnesium fluoride ($MgF_2$), composite optical ceramics, and similar materials. Although by no means limited to a particular geometry, seeker dome 18 will typically be either hemispherical or ogival in shape.

EM radiation sensors 22 are configured to receive electromagnetic radiation through seeker dome 18 emitted from or from a designated target to provide passive guidance, semi-active guidance, or active guidance in the conventionally-known manner. EM radiation sensors 22 may comprise any number of electromagnetic radiation detection devices suitable for performing this purpose and for detecting radiation within any given frequency band of the electromagnetic spectrum including, but not limited to, one or more of the ultraviolet, visible, infrared (e.g., near-infrared, mid-infrared, and far-infrared), microwave, and radio wave frequencies. As a non-exhaustive list of examples, EM radiation sensors 22 may include one or more visible spectrum, semi-active laser, infrared, and/or millimeter wave detection devices. In the illustrated exemplary embodiment wherein guided munition 12 assumes the form of a precision attack missile, EM radiation sensors 22 conveniently include an uncooled imaging infrared sensor and a semi-active laser sensor. In another embodiment wherein guided munition 12 assumes the form of a loitering attack missile, EM radiation sensors 22 may comprise one or more laser radar sensors.

As noted above, guided munition 12 includes a plurality of deployable flight control surfaces, which can be manipulated during munition flight by non-illustrated actuation means to provide aerodynamic guidance of guided munition 12 in accordance with homing data or command signals provided by seeker 19. In the illustrated example, specifically, guided munition 12 includes a plurality of wings 24 and a plurality of thrust vector control ("TVC") vanes 26, which are circumferential spaced around intermediate and aft portions of munition body 16, respectively. To facilitate storage within launch container 14, wings 24 and TVC vanes 26 are mounted to munition body 16 so as to be movable between a stowed or collapsed position (shown in FIG. 1) and a deployed position.

Launch container 14 can assume any form suitable for accommodating guided munition 12 prior to munition launch. In the exemplary embodiment illustrated in FIG. 1, launch container 14 assumes the form of an elongated launch tube having a closed end 30 and an open end 32. A container cover 34 is disposed over open end 32 to enclose launch container 14 and thereby protect munition 12 prior to munition launch. To initiate munition launch, rocket motor 28 is activated (e.g., via ignition of a non-illustrated ignition charge) to generate exhaust gases, which exit munition body 16 through a rocket nozzle (not shown) and provide forward thrust to munition 12. Guided by the walls of launch container 14, the exhaust gases flow over and around guided munition 12 in an aft-fore direction (i.e., upward in the illustrated orientation) to exert pressure on the inner face of container cover 34. When the pressure exerted on cover 34 surpasses a certain threshold, container cover 34 is effectively displaced from or blown-off of launch container 14 thereby facilitating the passage of guided munition 12 through open end 32. The forward end of guided munition 12 remains enveloped by rocket motor exhaust for a short distance of travel, typically equivalent to approximately one missile length, as the motor exhaust flowing through open end 32 forms a forward-expanding plume. An interlocking dome cover 20 overlays or encloses seeker dome 18 to prevent contamination of dome 18 by the surrounding motor exhaust during the launch sequence and munition fly-out. Shortly after munition launch, interlocking dome cover 20 deploys (i.e., separates and falls away from guided munition 12) to reveal seeker dome 18 and thereby enable the inflight operation of seeker 19. In preferred embodiments, interlocking dome cover 20 self-deploys without the aid of external devices (e.g., an actuator or timing electronics) when guided munition 12 surpasses a predetermined positive airspeed. The manner in which interlocking dome cover 20 is able to self-deploy at a predetermined juncture during munition flight without the aid of external devices is described more fully below in conjunction with FIGS. 2-7.

Figure 2:
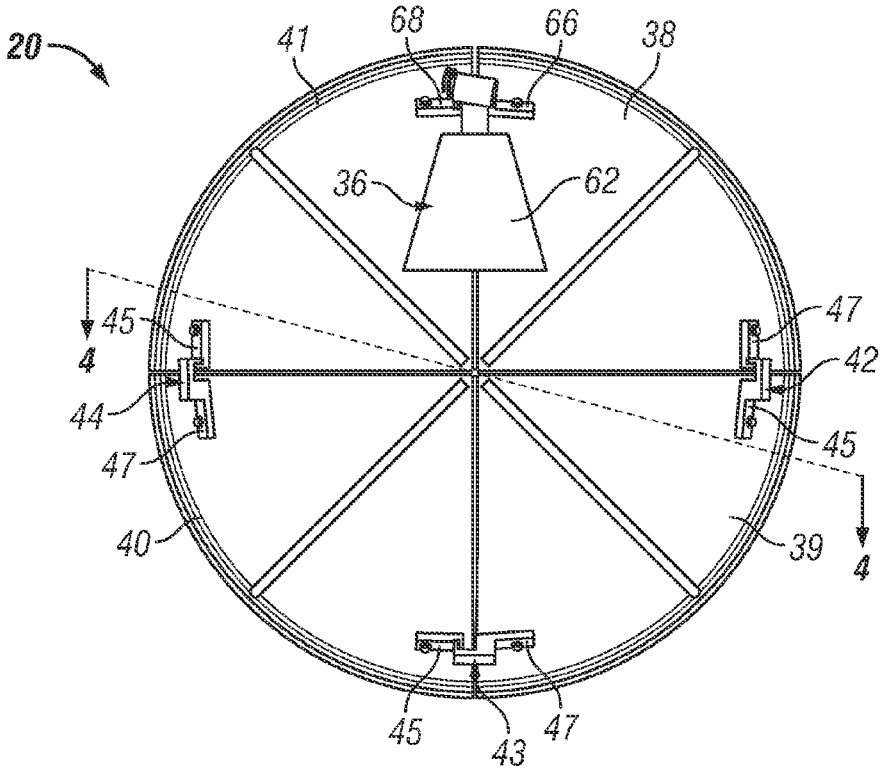
FIGS. 2 and 3 are top-down views of the interlocking dome cover prior to and during dome cover deployment, respectively.
Figure 3:
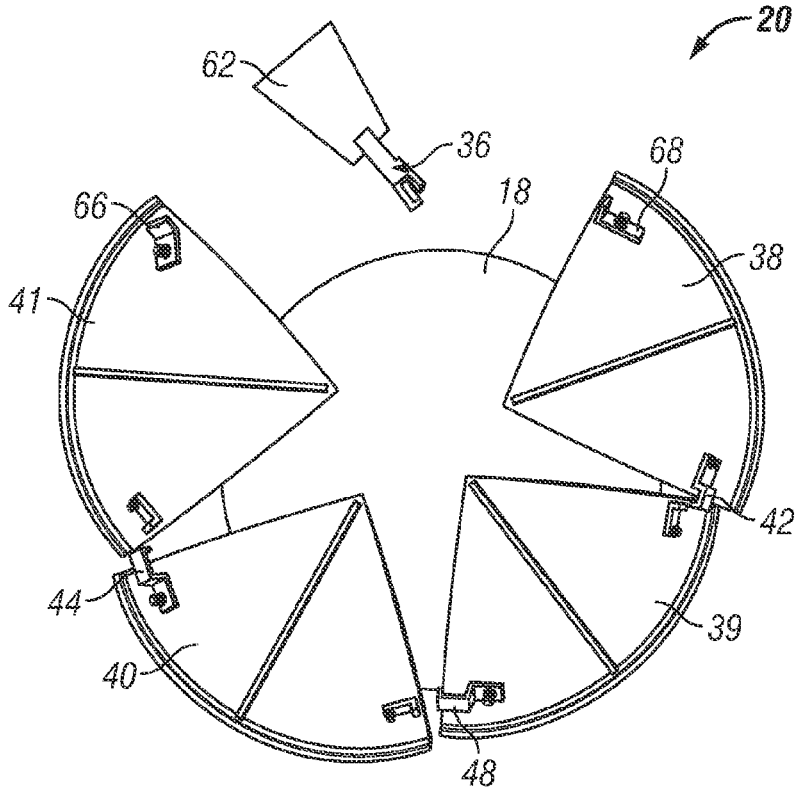

FIGS. 2 and 3 are top-down views illustrating an exemplary embodiment of interlocking dome cover 20 prior to and during dome cover deployment, respectively. Interlocking dome cover 20 includes a dome cover deployment device 36 and plurality of detachable dome cover sections 38-41. As shown in FIG. 2, dome cover sections 38-41 can be assembled to form a paraboloidal or dome-shaped structure, which mounts to the forward end of guided munition 12 and encloses seeker dome 18 (FIG. 3). By enclosing dome 18 in this manner, dome cover sections 38-41 collectively shield seeker dome 18 (FIG. 3) from potential sources of contamination, such as rocket motor exhaust generated during launch of guided munition 12 (FIG. 1). In the illustrated example, interlocking dome cover 20 includes four dome cover sections 38-41, which each make-up a different quadrant of a paraboloidal or hemispherical shell. Stated differently, dome cover sections 38-41 each assume the form of a substantially wedge-shaped panel that gradually decreases in width and curves radially inward when moving in an aft-fore direction. The instant example notwithstanding, the geometry, dimensions, and number of dome cover sections included within interlocking dome cover 20 vary amongst different embodiments providing that the dome cover sections can be assembled to form a dome-shaped enclosure suitable for shielding seeker dome 18 from potential sources of contamination. In certain embodiments, it may be desirable for interlocking dome cover 20 to include a greater number of dome cover sections to minimize individual section size and, therefore, the size of the debris generated during dome cover deployment.

When interlocking dome cover 20 is assembled over seeker dome 18, a close tolerance or mating fit is provided between the neighboring longitudinal edges of dome cover sections 38-41. In preferred embodiments, the neighboring edges of dome cover sections 38-41 overlap, as taken in a radial direction through the thickness of interlocking dome cover 20, to provide a more torturous gas flow path through dome cover 20 and thereby deter leakage of high velocity exhaust flow across dome cover 20. For example, as shown in FIG. 2, interlocking dome cover 20 may be fabricated such that the neighboring edges of sections 38-41 join together to form a stepped interface or lap joint. Alternatively, the neighboring edges of sections 38-41 may combine form other types of radially-overlapping joints, such as dovetail joints. If desired, one or more seals (e.g., an elongated strip of rubber) may be positioned between neighboring side edges of dome cover sections 38-41 to further deter exhaust leakage through interlocking dome cover 20 during launch of guided munition 12 (FIG. 1).

Figure 4:
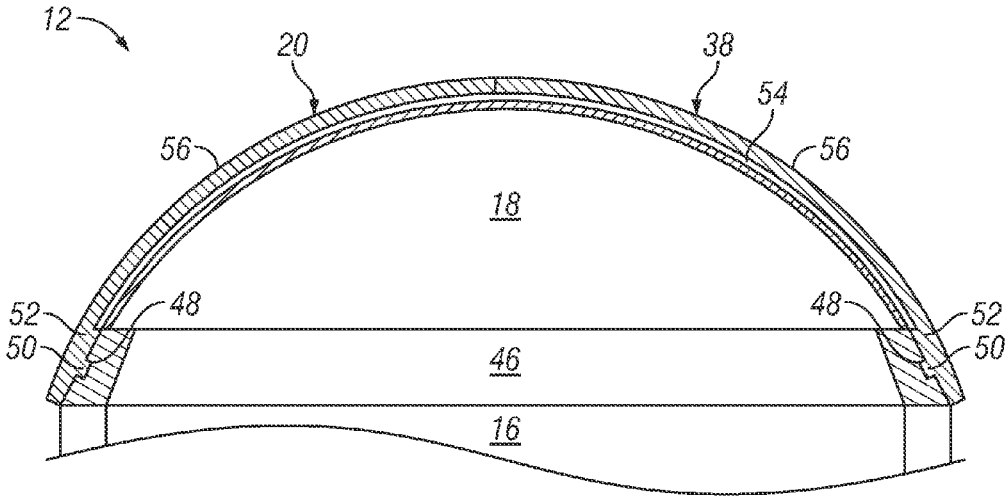
FIG. 4 is a cross-sectional view of the forward end of the guided munition shown in FIG. 1 and the interlocking dome cover shown in FIGS. 1-3, as taken along line 4-4 in FIG. 2.

FIG. 4 is a cross-sectional view of dome cover 20 and the forward end of munition body 16, as taken along line 4-4 in FIG. 2. As can be seen in FIG. 4, a dome mounting ring 46 joins seeker dome 18 to the main portion or fuselage of munition body 16. A plurality of radial openings 48 is formed through the outer circumferential surface dome mounting ring 46; e.g., four such openings 48 may be provided in mounting ring 46 (only two of which can be seen in FIG. 4), which may be substantially evenly spaced around the outer circumferential surface of ring 46 at 90° intervals. Interlocking dome cover 20 further includes a plurality of inner radial projections 50, which are circumferentially spaced around an inner portion of cover 20 and which extend radially inward from dome cover sections 38-41 to engage radial openings 48. Each radial projection 50 may assume the form of a bump- or button-shaped projection 50, which extends radially inward from the base portion of a different dome cover section and into one of radial opening 48; thus, in the illustrated example, dome cover sections 38-41 may include four such radial projections 50, which are spaced evenly around the inner circumference of the structure collectively formed by sections 38-41 at 90° intervals to correspond to the spacing of openings 48. As a result of this mounting interface, dome cover sections 38-41 positively register to, and interlocking dome cover 20 securely mounts to, the forward end of munition body 16. Interlocking dome cover 20 may thus remain securely in place over seeker dome 18 even when exposed to high velocity aft-fore exhaust flow during munition launch and/or when subjected to high vibratory or shock forces that may occur during transport and solider handling. Notably, dome mounting ring 46 may conventionally be provided with radial openings 48 to facilitate threaded attachment of ring 46 to the munition fuselage utilizing a specialized tool during munition assembly; thus, in such a case, the above-described mounting interface takes advantage of pre-existing structural features already provided in dome mounting ring 46 in securing interlocking dome cover 20 to the body of guided munition 12.

With continued reference to FIG. 4, a generally hemispherical air gap or clearance 54 may be provided between dome cover sections 38-41 and seeker dome 18. Internal clearance 54 may be created by imparting the base or aft portion 52 of each dome cover section 38-41 with an increased radial thickness as compared to the main body 56 of the dome cover section. Internal clearance 54 serves to decrease the likelihood of contact between dome cover sections 38-41 and seeker dome 18, and thus decrease the likelihood of dome scratching, during dome cover deployment. To further reduce the likelihood of dome scratching, dome cover sections 38-41 may be fabricated from a lightweight, non-abrasive material; the inner surfaces of dome cover sections 38-41 may be imparted with relatively smooth contours; and/or the inner surfaces of dome cover sections 38-41 may be coated with a non-abrasive material.

Interlocking dome cover 20 further includes a plurality of detachable hinges 42-44, which couple neighboring pairs of detachable dome cover sections 38-41 when interlocking dome cover 20 is assembled over seeker dome 18 (FIG. 1). As shown most clearly in FIG. 2, each detachable hinge 42 includes a radially-projecting catch 45, which is fixedly coupled a first dome cover section, and a hook-shaped hinge arm 47, which is fixedly coupled to a second, neighboring dome cover section. In a preferred embodiment, catch 45 and hinge arm 47 are each integrally formed with their respective dome cover section as, for example, a single molded piece.

When dome cover sections 38-41 are assembled, each hinge arm 47 engages or hooks onto its respective catch 45 to form a hinged coupling. Detachable hinges 42-44 allow relative rotation of dome cover sections 38-41 outward from the longitudinal axis of guided munition 12 and, therefore, disengagement of sections 38-41 from dome mounting ring 46. In particular, upon actuation of deployment device 36, dome cover sections 38 and 41 are free to rotate outward from guided munition 12 about detachable hinges 42 and 44, respectively, and thereby detach from guided munition 12. As dome cover sections 38 and 41 rotate outward and detach from guided munition 12, dome cover sections 39 and 40 likewise become free to rotate outward and detach from guided munition 12. Actuation of deployment device 36 thus results in the separation of the various dome cover sections 38-41 and the exposure of seeker dome 18, as generally illustrated in FIG. 3. Furthermore, as hinged coupling features 42-44 are freely detachable, dome cover sections 38-41 separate into individual pieces during dome cover deployment, which fall away from guided munition 12 as relatively small, lightweight, and low-energy debris.

Dome cover deployment device 36 may assume any form, and may include any number of components, suitable for initiating separation of dome cover sections 38-41 at a desired time of deployment. Dome cover deployment device 36 may generate a force urging separation of dome cover sections 38-41 or, instead, simply release dome cover sections 38-41 from an assembled state to allow sections 38-41 to separate under the influence of gravitational and aerodynamic forces. In certain embodiments, deployment device 36 may assume the form of, or include, one or more pyrotechnic devices. This notwithstanding, deployment device 36 preferably assumes the form of a latch and, more preferably, a wind-actuated latch configured to actuate in response to aerodynamic forces when guided munition 12 surpasses a predetermined airspeed; for this reason, dome cover deployment device 36 may be referred to as "wind-actuated latch 36" hereafter. Although only a single dome cover deployment device 36 is shown in FIGS. 2 and 3, interlocking dome cover 20 may include multiple dome cover deployment devices in alternative embodiments for the purposes of redundancy.

Figure 5:
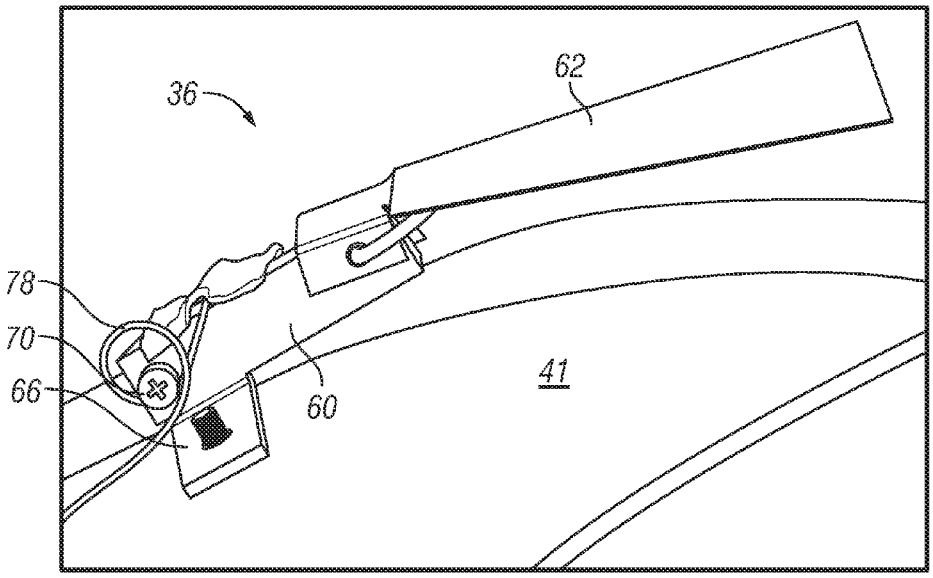
FIGS. 5 and 6 are side and bottom views, respectively, of a wind-actuated latch suitable for usage as the dome cover deployment device in the interlocking dome cover shown in FIGS. 1-4.
Figure 6:
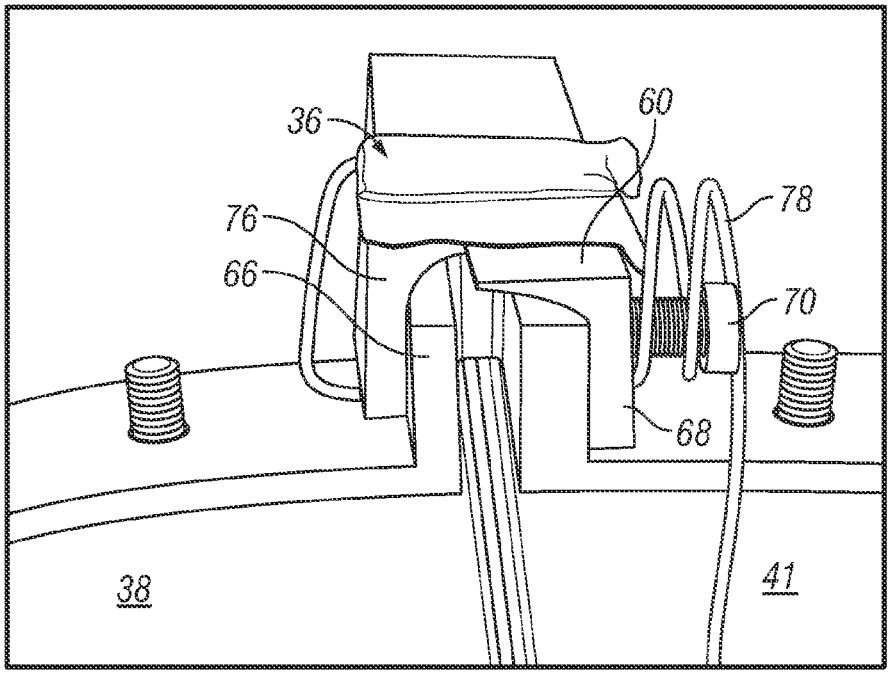
Figure 7:
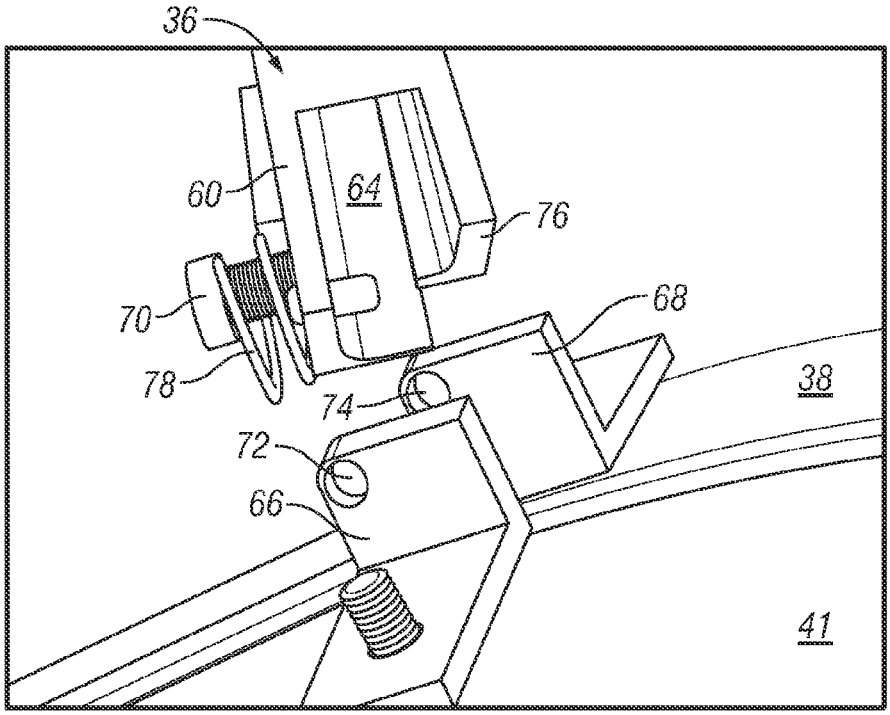
FIG. 7 is a side view of the exemplary wind-actuated latch shown in FIGS. 5 and 6 immediately after actuation thereof.

FIG. 5 is an isometric view of a portion of interlocking dome cover 20 illustrating wind-actuated latch 36 in greater detail; and FIGS. 6 and 7 are isometric views of wind-actuated latch 36 before and immediately after actuation thereof, respectively. Referring collectively to FIGS. 5-7, wind-actuated latch 36 includes a retainer portion 60 and a wind-blocking member 62, which extends from retainer portion 60 in a generally forward direction. As shown most clearly in FIGS. 6 and 7, a substantially U-shaped channel 64 is provided in the underside of retainer portion 60 and opens toward the exterior surface of dome cover sections 38 and 41. A first tab 66 and a second tab 68 project radially outward from dome cover sections 41 and 38, respectively, and are received within channel 64. A hinge pin 70 extends through an opening provided in a sidewall of retainer portion 60 and through aligning eyelets 72 and 74 provided in tabs 66 and 68, respectively (identified in FIG. 7), to rotatably couple wind-actuated latch 36 to dome cover sections 38 and 41. Wind-actuated latch 36 is movable between a latched position (shown in FIGS. 5 and 6) and an unlatched position (not shown). In the latched position (FIGS. 5 and 6), wind-blocking member 62 resides adjacent dome cover sections 38 and 41 (shown most clearly in FIG. 5), and retainer portion 60 retains tabs 66 and 68 in a neighboring or side-by-side relationship to maintain the relative positioning of dome cover sections 38 and 41. When latch 36 rotates into the unlatched position, wind-blocking member 62 rotates away from dome cover sections 38 and 41 and an opening 76 provided through a sidewall of retainer portion 60 (shown in FIGS. 6 and 7) rotates into alignment with tab 68. No longer retained by wind-actuated latch 36, dome cover sections 38 and 41 are free to rotate outward and disengage from munition body 12. As generally indicated in FIG. 7, hinge pin 70 may also disengage from eyelets 72 and 74, and wind-actuated latch 36 may separate from dome cover sections 38 and 41 to further reduce the size of debris. In preferred embodiments, wind-actuated latch 36 is biased toward the latch position to prevent premature or inadvertent actuation of interlocking dome cover 20 during transport or solider handing; e.g., a torsion spring 78 may be mounted around hinge pin 70 to bias latch 36 toward the latched position as generally shown in FIGS. 5 and 6.

As stated above, wind-actuated latch 36 is rotatably coupled to dome cover sections 38-41 and normally resides in a latched position in which latch 36 maintains sections 38-41 in the assembled state shown in FIG. 2 and FIGS. 4-7. When rotated into the unlatched position, latch 36 releases tabs 66 and 68 to allow the separation of dome cover sections 38 and 41, and the subsequent separation of 39-40, under the influence of aerodynamic and gravitational forces, as previously described. In preferred embodiments, wind-actuated latch 36 is configured to be actuated by fore-aft airflow acting on wind-blocking member 62 during munition flight. In particular, when impinged by sufficient airflow flowing over guided munition 12 in a forward-aft direction to overcome the bias force exerted on member 62 by torsion spring 78, wind-actuated latch 36 rotates in a first rotational direction away from the longitudinal axis of guided munition 12 and into the unlatched position to initiate release of dome cover sections 38-41. Wind-actuated latch 36 is generally prevented from rotating in the second, opposing rotational direction by abutment with dome cover sections 38-41. Wind-actuated latch 36 thus cannot be actuated by high velocity flowing over guided munition 12 and interlocking dome cover 20 during munition launch in an aft-fore direction. Notably, the particular airspeed at which wind-actuated latch 36 is actuated by fore-aft airflow, and thus the particular airspeed at which interlocking dome cover 20 deploys, can be tailored by adjusting various structural aspects of dome cover 20, including the bias force exerted on latch 36 by spring 78 and the effective surface area of wind-blocking member 62.

It should thus be appreciated that there has been provided multiple exemplary embodiments of a guided munition, such as a containerized guided missile, including an interlocking dome cover that reliably self-deploys at a desired juncture without the aid of an actuator, timing electronics, or similar devices. Advantageously, the above-described exemplary interlocking dome covers are relatively compact, inexpensive to implement, and produce little to no high-energy debris upon deployment. The foregoing has also provided exemplary embodiments of a method for equipping a guided munition including a seeker dome with an interlocking dome cover. In one implementation, the above-described method includes the step of assembling a plurality of detachable dome cover sections over a seeker dome to form a dome-shaped structure enclosing the seeker dome, and the step of coupling a dome cover deployment device to the plurality of detachable dome cover sections to maintain the plurality of detachable dome cover sections in the assembled state over the seeker dome. The dome cover deployment device is configured to release the plurality of detachable dome cover sections from the assembled state upon actuation to enable separation of the plurality of detachable dome cover sections and exposure of the seeker dome.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A guided munition comprising:
a munition body;
a seeker dome coupled to the munition body; and
an interlocking dome cover, comprising:
a plurality of detachable dome cover sections that interlock with one another and that collectively enclosing the seeker dome; and
a dome cover deployment device coupled to the plurality of detachable dome cover sections and, when actuated, initiating separation of the plurality of detachable dome cover sections to expose the seeker dome;
wherein the dome cover deployment device normally maintains the plurality of detachable dome cover sections in an assembled state over the seeker dome and, when actuated, releases the plurality of detachable dome cover sections from the assembled state.

2. A guided munition according to claim 1 wherein the dome cover deployment device is configured to independently actuate when the guided munition surpasses a predetermined airspeed.

3. A guided munition according to claim 2 wherein the dome cover deployment device comprises a wind-actuated latch.

4. A guided munition according to claim 3 wherein the wind-actuated latch is rotatably coupled to the plurality of detachable dome cover sections and is rotatable between (i) a latched position wherein the wind-actuated latch maintains the plurality of detachable dome cover sections in an assembled state over the seeker dome, and (ii) a unlatched position wherein the wind-actuated latch releases the plurality of detachable dome cover sections from the assembled state.

5. A guided munition according to claim 4 wherein the wind-actuated latch is configured to detach from the plurality of detachable dome cover sections when moving from the latched position toward the unlatched position.

6. A guided munition according to claim 4 wherein the wind-actuated latch rotates away from the longitudinal axis of the guided munition when rotating from the latched position toward the unlatched position.

7. A guided munition according to claim 4 wherein the wind-actuated latch is biased toward the latched position.

8. A guided munition according to claim 4 wherein the wind-actuated latch comprises:
a hinge pin rotatably coupled to the plurality of detachable dome cover sections; and
a wind-blocking member extending from the hinge pin in a generally forward direction and residing substantially adjacent the plurality of detachable dome cover sections in the latched position.

9. A guided munition according to claim 2 further comprising an internal clearance between seeker dome and the plurality of detachable dome cover sections when the interlocking dome cover is assembled over the seeker dome.

10. A guided munition comprising:
a munition body;
a seeker dome coupled to the munition body;
an interlocking dome cover, comprising:
a plurality of detachable dome cover sections that interlock with one another and that collectively enclosing the seeker dome; and
a dome cover deployment device coupled to the plurality of detachable dome cover sections and, when actuated, initiating separation of the plurality of detachable dome cover sections to expose the seeker dome; and
at least one detachable hinge coupling at least one neighboring pair of the plurality of detachable dome cover sections.

11. A guided munition according to claim 10 wherein the plurality of detachable dome cover sections comprises:
a first detachable dome cover section having a first edge portion; and
a second detachable dome cover section having a second edge portion matingly engaging the first edge portion when the interlocking dome cover is assembled.

12. A guided munition according to claim 11 wherein the hinge comprises:
a catch coupled to the first detachable dome cover section; and
a hinge arm coupled to the second detachable dome cover section and hooking onto the catch when the interlocking dome cover is assembled.

13. A guided munition according to claim 11 wherein the first edge portion and the second edge portion overlap radially when the interlocking dome cover is assembled.

14. A guided munition comprising:
a munition body;
a seeker dome coupled to the munition body; and
an interlocking dome cover, comprising:
a plurality of detachable dome cover sections that interlock with one another and that collectively enclosing the seeker dome; and
a dome cover deployment device coupled to the plurality of detachable dome cover sections and, when actuated, initiating separation of the plurality of detachable dome cover sections to expose the seeker dome;
wherein the plurality of detachable dome cover sections comprises a plurality of inner radial projections matingly engaging the munition body and configured to disengage therefrom during dome cover deployment.

15. A guided munition according to claim 14 wherein the munition body comprises a dome mounting ring coupled to the seeker dome and having a plurality of radial openings therein, the plurality of radial openings each receiving a different one of the plurality of inner radial projections when the interlocking dome cover is assembled over the seeker dome.

16. A guided munition, comprising:
a munition body;
a seeker dome coupled to the munition body; and
an interlocking dome cover, comprising:
a plurality of detachable dome cover sections assembled together to interlock with one another and to form a dome-shaped enclosure over the seeker dome; and
a wind-actuated latch normally maintaining the plurality of detachable dome cover sections in the assembled state over the seeker dome, the wind-actuated latch configured to release the plurality of detachable dome cover sections from the assembled state when the guided munition surpasses a predetermined airspeed to enable separation of the plurality of detachable dome cover sections and exposure of the seeker dome.

17. A guided munition according to claim 16 further comprising a plurality of detachable hinges coupling neighboring pairs of the plurality of detachable dome cover sections.

18. A method for equipping a guided munition including a seeker dome with an interlocking dome cover, the method comprising the steps of:

assembling a plurality of detachable dome cover sections over the seeker dome to form a dome-shaped structure enclosing the seeker dome, with the plurality of detachable dome cover sections interlocking with one another; and coupling a dome cover deployment device to the plurality of detachable dome cover sections to maintain the plurality of detachable dome cover sections in the assembled state over the seeker dome, the dome cover deployment device configured to release the plurality of detachable dome cover sections from the assembled state upon actuation to enable separation of the plurality of detachable dome cover sections and exposure of the seeker dome.

19. A method according to claim 18 wherein the guided munition further includes dome mounting ring coupled to the seeker dome, and wherein the step of assembling comprises detachably mounting the plurality of detachable dome cover sections to the dome mounting ring.

* * * * *